US012396617B2

(12) United States Patent
Michel

(10) Patent No.: US 12,396,617 B2
(45) Date of Patent: Aug. 26, 2025

(54) SHOE SANITIZING METHOD

(71) Applicant: Sabina Michel, Queens Village, NY (US)

(72) Inventor: Sabina Michel, Queens Village, NY (US)

( * ) Notice: Subject to any disclaimer, the term of this patent is extended or adjusted under 35 U.S.C. 154(b) by 649 days.

(21) Appl. No.: 17/690,509

(22) Filed: Mar. 9, 2022

(65) Prior Publication Data

US 2023/0284869 A1 Sep. 14, 2023

(51) Int. Cl.

| | |
|---|---|
| ***A61L 2/00*** | (2006.01) |
| ***A47L 23/02*** | (2006.01) |
| ***A47L 23/26*** | (2006.01) |

(52) U.S. Cl.

CPC ..... *A47L 23/266* (2013.01)

(58) Field of Classification Search

CPC ..... A61L 2/18; A61L 2/24; A61L 2/10; A47K 3/022; A47L 23/26

USPC ..... 422/1, 28, 37, 297, 301; 15/34

See application file for complete search history.

(56) References Cited

U.S. PATENT DOCUMENTS

| | | | | |
|---|---|---|---|---|
| 8,973,197 | B2 | 3/2015 | Omidi | |
| 10,702,621 | B1 | 7/2020 | Patton | |
| D893,217 | S | 8/2020 | Meyer | |
| 10,894,108 | B2 | 1/2021 | Jackson | |
| 2010/0296970 | A1 | 11/2010 | Trimarco | |
| 2016/0015844 | A1 | 1/2016 | Collins | |
| 2019/0133414 | A1* | 5/2019 | Barnhill | A47L 23/20 |
| 2019/0321503 | A1 | 10/2019 | Warnell | |

FOREIGN PATENT DOCUMENTS

| | | |
|---|---|---|
| WO | WO2019090335 | 5/2019 |

* cited by examiner

*Primary Examiner* — Monzer R Chorbaji

(57) ABSTRACT

A shoe sanitizing method includes the pouring of a sanitizing agent on an absorbent pad positioned in a housing to saturate the absorbent pad with the sanitizing agent. A person steps on the absorbent pad with a shoe such that a bottom of the shoe is cleaned with the sanitizing agent. The shoe is removed from the absorbent pad and the absorbent pad is removed from the housing for cleaning or replacement when the absorbent pad is soiled.

6 Claims, 4 Drawing Sheets

SHOE SANITIZING METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shoe sanitizing device and more particularly pertains to a new shoe sanitizing device for allowing a person to sanitize a bottom of their shoe as they are wearing it. Thus, the sanitizing device disclosed herein may also be used as a door mat.

(2) Description of Related Art Including Information Disclosed Under 37 CFR 1.97 and 1.98

The prior art relates to shoe sanitizing devices that wipe down a shoe to disinfect the shoe.

BRIEF SUMMARY OF THE INVENTION

An embodiment of the disclosure meets the needs presented above by generally including the pouring of a sanitizing agent on an absorbent pad positioned in a housing to saturate the absorbent pad with the sanitizing agent. A person steps on the absorbent pad with a shoe such that a bottom of the shoe is cleaned with the sanitizing agent. The shoe is removed from the absorbent pad and the absorbent pad is removed from the housing for cleaning or replacement when the absorbent pad is soiled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
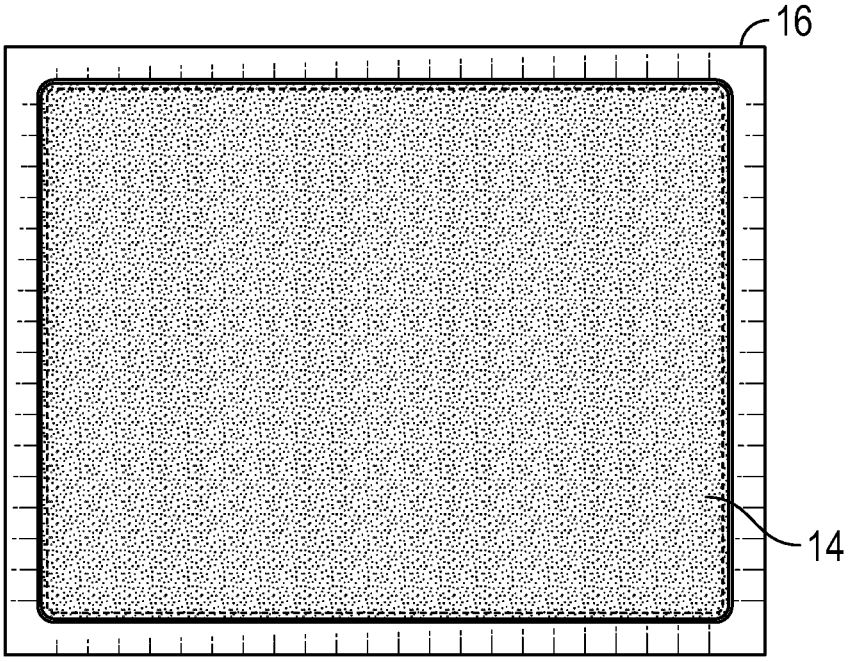
FIG. 1 is a top view of a shoe sanitizing method according to an embodiment of the disclosure.
Figure 2:
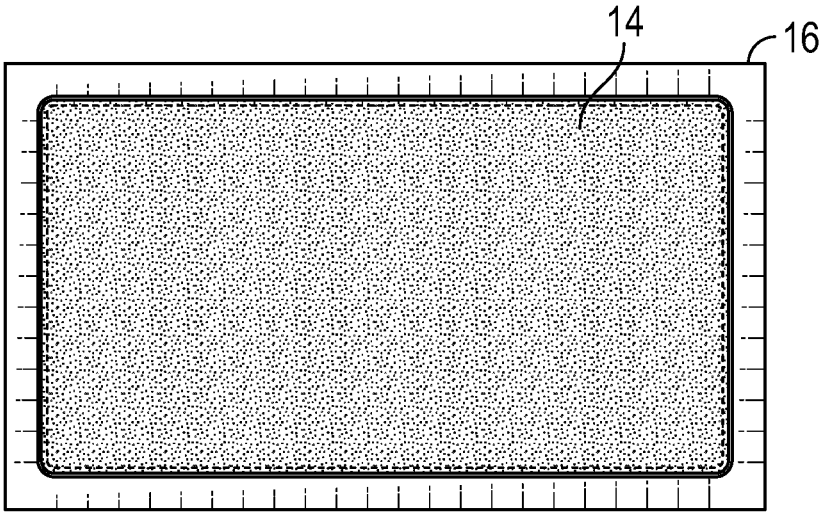
FIG. 2 is a top view of a second embodiment of the disclosure.
Figure 3:
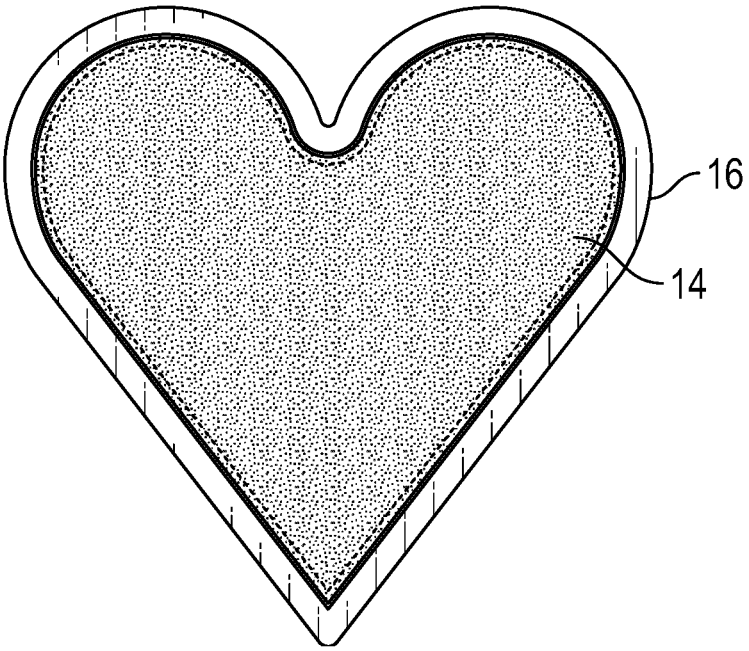
FIG. 3 is a top view of a third embodiment of the disclosure.
Figure 4:
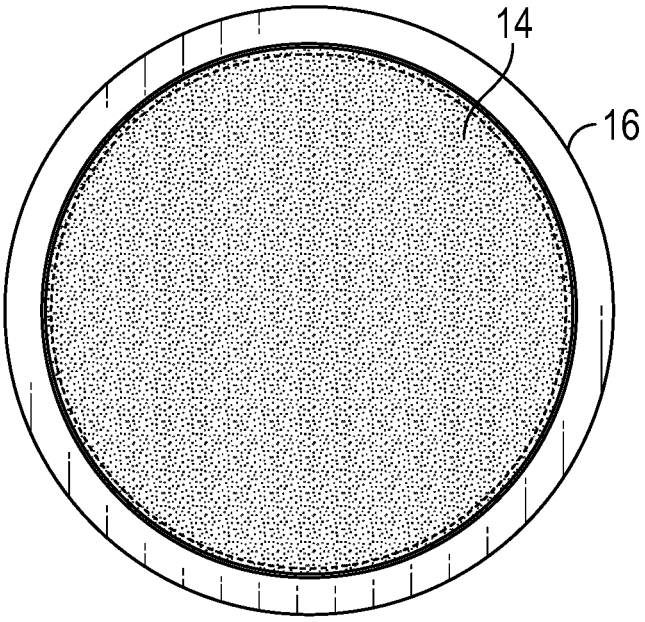
FIG. 4 is a top view of a fourth embodiment of the disclosure.
Figure 5:
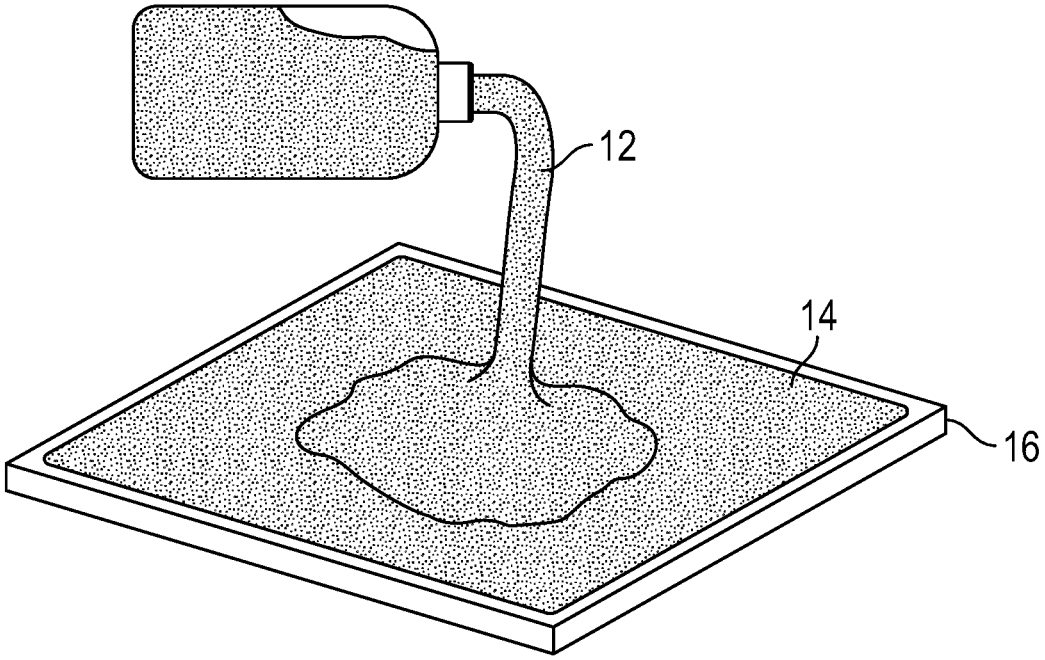
FIG. 5 is a top isometric in-use view of an embodiment of the disclosure.
Figure 6:
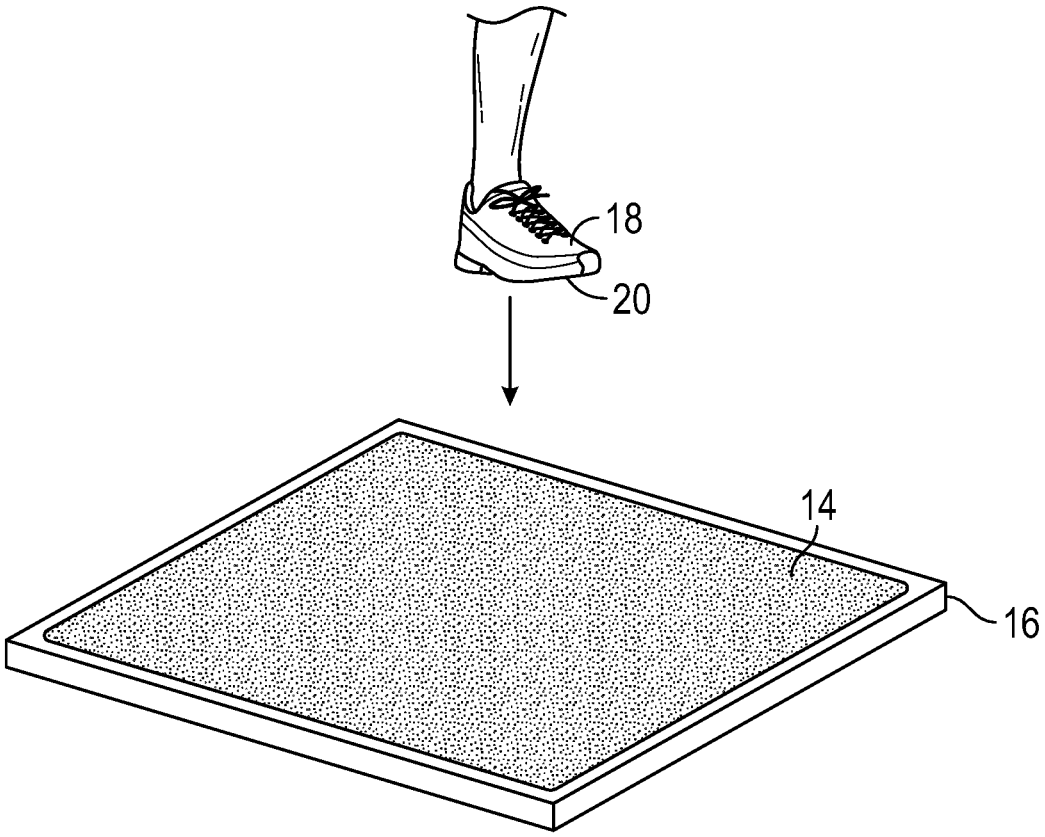
FIG. 6 is a top isometric in-use view of an embodiment of the disclosure.
Figure 7:
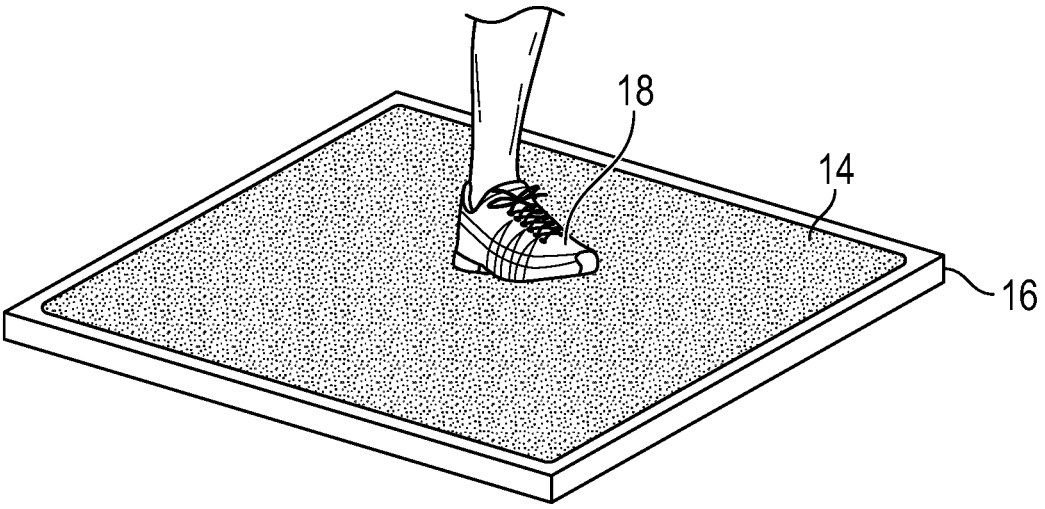
FIG. 7 is a top isometric in-use view of an embodiment of the disclosure.
Figure 8:
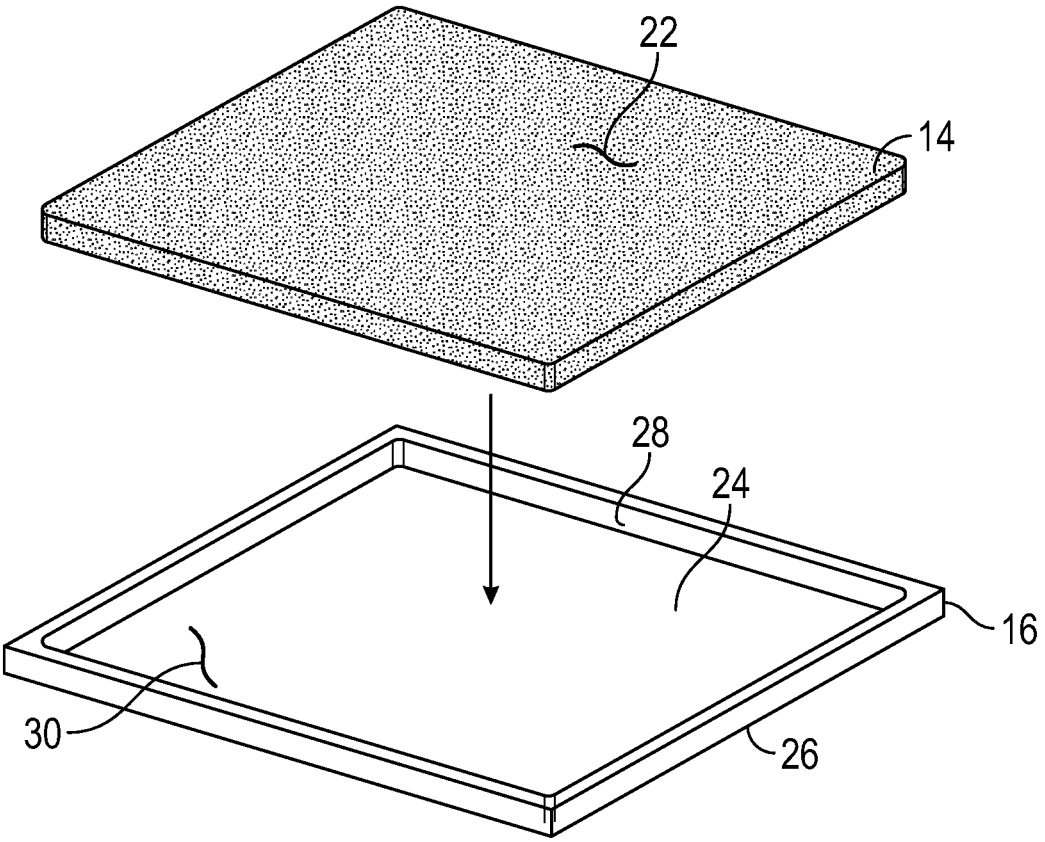
FIG. 8 is a top isometric view of an embodiment of the disclosure.

With reference now to the drawings, and in particular to FIGS. 1 through 8 thereof, a new shoe sanitizing device embodying the principles and concepts of an embodiment of the disclosure and generally designated by the reference numeral 10 will be described.

As best illustrated in FIGS. 1 through 8, the shoe sanitizing method 10 generally comprises pouring a sanitizing agent 12 on an absorbent pad 14 positioned in a housing 16 to saturate the absorbent pad 14 with the sanitizing agent 12. The sanitizing agent 12 may comprise any conventional composition utilized for cleaning a shoe 18 in such a manner that bacteria on a bottom side 20 of the shoe 18 is killed. However, a sanitizing agent 12 may be selected which does not damage flooring should the shoe 18 be worn after being sanitized. Additionally, the absorbent pad 14 may include a frictionally enhanced service to remove any debris or residue from the shoe 18.

The absorbent pad 14 has a height greater than 0.5 inches and less than 4.0 inches and will typically have an upper surface 22 with an area that is greater than 1.0 $ft^2$. The absorbent pad 14 will typically be comprised of a foam material having high absorptive properties. This may be preferred over a paper-based product which cannot be washed. However, natural materials which can be woven such as cotton or hemp may be used instead of a synthetic foam material.

The housing 16 is comprised of a water impermeable material which may include plastics, metals, elastomers and the like. The housing 16 includes a bottom wall 24 that has a perimeter edge 26. A perimeter wall 28 is coextensive with and extends upwardly from the perimeter edge 26. A height that the perimeter wall 28 extends upwardly from an upper side 30 of the bottom wall 24 is within 0.5 inches of the height of the absorbent pad 14. As can be seen in the Figures, the housing 16 and absorbent pad 12 may be provided in a variety of shapes and sizes as is desired by a user of the method 10.

Once the absorbent pad 14 has been saturated with the sanitizing agent 12, a person will step upon the absorbent pad 14 with their shoe 20 such that a bottom 20 of the shoe 18 is cleaned with the sanitizing agent 12 as the sanitizing agent 12 is transferred from the absorbent pad 14 to the shoe 20. The shoe 20 is then removed from the absorbent pad 14 and worn in a conventional manner. After being used multiple times, the absorbent pad 14 may become soiled. At this time, the absorbent pad 14 may be removed from the housing 16 for cleaning or replacement.

Other methods contemplated may include the sanitizing other objects which are positioned on the absorbent pad 14. This may include, for example, bare feet, luggage wheels, stroller wheels, and the like. Additionally, when pet safe sanitizing agent 12 is utilized, the method may include sanitizing pet feet by have pets walk onto the absorbent pad 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of sanitizing footwear before walking on a floor surface, the method including the steps of:

pouring a sanitizing agent on an absorbent pad positioned in a housing to saturate the absorbent pad with the sanitizing agent, the housing including a bottom wall having a perimeter edge, a perimeter wall being coextensive with and extending upwardly from the perimeter edge, a height of the perimeter wall extending upwardly from an upper side of the bottom wall such that an upper surface of the absorbent pad is coplanar with an upper edge of the perimeter wall;

stepping on the absorbent pad with a shoe such that a bottom of the shoe is cleaned with the sanitizing agent;

removing the shoe from the absorbent pad; and removing the absorbent pad from the housing when the absorbent pad is soiled.

2. The method of sanitizing footwear before walking on a floor surface according to claim 1, wherein the step of pouring the sanitizing agent on the absorbent pad further includes the absorbent pad having a height greater than 0.5 inches and less than 4.0 inches.

3. The method of sanitizing footwear before walking on a floor surface according to claim 1, wherein the step of pouring the sanitizing agent on the absorbent pad further includes the upper surface of the absorbent pad having an area being greater than 1.0 $ft^2$.

4. The method of sanitizing footwear before walking on a floor surface according to claim 1, wherein the step of pouring the sanitizing agent on the absorbent pad further includes the absorbent pad being comprised of a foam material.

5. The method of sanitizing footwear before walking on a floor surface according to claim 1, wherein the step of pouring the sanitizing agent on the absorbent pad further includes the housing being comprised of a water impermeable material.

6. A method of sanitizing footwear before walking on a floor surface, the method including the steps of:

pouring a sanitizing agent on an absorbent pad positioned in a housing to saturate the absorbent pad with the sanitizing agent, the absorbent pad having a height greater than 0.5 inches and less than 4.0 inches, the absorbent pad having an upper surface having an area being greater than 1.0 $ft^2$, the absorbent pad being comprised of a foam material, the housing being comprised of a water impermeable material, the housing including a bottom wall having a perimeter edge, a perimeter wall being coextensive with and extending upwardly from the perimeter edge, a height of the perimeter wall extending upwardly from an upper side of the bottom wall such that the upper surface of the absorbent pad is coplanar with an upper edge of the perimeter wall;

stepping on the absorbent pad with a shoe such that a bottom of the shoe is cleaned with the sanitizing agent;

removing the shoe from the absorbent pad; and removing the absorbent pad from the housing when the absorbent pad is soiled.

* * * * *